US010186143B2

(12) United States Patent
Ali-Jarad et al.

(10) Patent No.: US 10,186,143 B2
(45) Date of Patent: Jan. 22, 2019

(54) SYSTEMS AND METHODOLOGIES FOR ALERTING EMERGENCY RESPONDERS

(71) Applicant: University of Dammam, Dammam (SA)

(72) Inventors: Gufran Ali-Jarad, Dammam (SA); Sarah Madi Alhajri, Dammam (SA); Yqeen Ali Alkhalaf, Dammam (SA); Waad Saleh Alhareth, Dammam (SA); Aisha Hussain Aldossary, Dammam (SA)

(73) Assignee: University of Dammam, Dammam (SA)

( * ) Notice: Subject to any disclaimer, the term of this patent is extended or adjusted under 35 U.S.C. 154(b) by 91 days.

(21) Appl. No.: 15/355,904

(22) Filed: Nov. 18, 2016

(65) Prior Publication Data

US 2018/0144613 A1 May 24, 2018

(51) Int. Cl.
*G08B 27/00* (2006.01)

(52) U.S. Cl.
CPC ..... *G08B 27/001* (2013.01)

(58) Field of Classification Search
CPC ..... G08B 19/00; G08B 25/00; G08B 25/007; G08B 27/001
See application file for complete search history.

(56) References Cited

U.S. PATENT DOCUMENTS 6,759,954 B1 * 7/2004 Myron ..... H05B 37/0227 315/294
9,612,589 B1 * 4/2017 Dawson-Haggerty ..... G05D 23/19
2005/0190053 A1 9/2005 Dione
2007/0024708 A1 2/2007 Lin et al.
2009/0027225 A1 1/2009 Farley
2012/0047083 A1 2/2012 Qiao et al.
2012/0276517 A1 * 11/2012 Banaszuk ..... G01C 21/00 434/365

(Continued)

FOREIGN PATENT DOCUMENTS

WO WO 2015/184217 A1 12/2015

OTHER PUBLICATIONS

Y. Ma, et al., "Decentralized Evacuation System Based on Occupants Distribution and Building Information" http://publish.ucc.ie/boolean/2010/00/Manzoor/20/en_, May 24-27, 2015, pp. 1-7.

(Continued)

*Primary Examiner* — Brian Wilson
(74) *Attorney, Agent, or Firm* — Oblon, McClelland, Maier & Neustadt, L.L.P.

(57) ABSTRACT

A method and system for alerting emergency responders. The method includes acquiring readings from one or more occupancy sensors of a building, determining an occupancy estimate based on the readings from the one or more occupancy sensors, storing the occupancy estimate in a server, determining whether an emergency event has occurred at the building based on one or more threat parameters received from one or more threat sensors. Further, the method includes outputting a notification to at least one external device of emergency responders and transmitting building information associated with the emergency event to the emergency responders when the emergency event has occurred. The building information includes the occupancy estimate.

19 Claims, 11 Drawing Sheets

(56) References Cited

U.S. PATENT DOCUMENTS

| | | | | |
|---|---|---|---|---|
| 2013/0120137 | A1 | 5/2013 | Lehmann | |
| 2013/0278420 | A1* | 10/2013 | Araiz-Boys | G08B 25/12 340/539.18 |
| 2016/0047663 | A1* | 2/2016 | Iyer | G01C 21/3415 701/411 |
| 2016/0100233 | A1* | 4/2016 | Fadell | G05B 15/02 340/870.02 |
| 2017/0027045 | A1* | 1/2017 | Chemel | G05B 15/02 |

OTHER PUBLICATIONS

F. Manzoor, et al., "Occupant monitoring for facility management using Radio Frequency Identification" http://publish.ucc.ie/boolean/2010/00/Manzoor/20/en_, 2010, pp. 1-2.

* cited by examiner

300

| Sensor | Type | Coverage Area | Status |
|---|---|---|---|
| 0001 | Video | A | Normal |
| 0002 | Infrared | A, B | Error |
| 0003 | Video | B | Normal |

FIG. 3

700

| Sensor type | Threat type | Performance |
|---|---|---|
| Video | Smoke | Mediocre |
| Indoor localization | Smoke | Excellent |

*FIG. 7*

SYSTEMS AND METHODOLOGIES FOR ALERTING EMERGENCY RESPONDERS

BACKGROUND

Emergency services and rescue services are organizations that ensure public safety and health by addressing different emergencies that arise. Delays in providing emergency details to responders can have severe consequences.

The foregoing "Background" description is for the purpose of generally presenting the context of the disclosure. Work of the inventor, to the extent it is described in this background section, as well as aspects of the description which may not otherwise qualify as prior art at the time of filing, are neither expressly or impliedly admitted as prior art against the present invention.

SUMMARY

The present disclosure relates to a method for alerting emergency responders that acquires readings from one or more occupancy sensors of a building; determines, using processing circuitry of a server, an occupancy estimate based on the readings from the one or more occupancy sensors; stores the occupancy estimate in the server; determines whether an emergency event has occurred at the building based on one or more threat parameters received from one or more threat sensors; outputs a notification to at least one external device of emergency responders when the emergency event has occurred; and transmits building information associated with the emergency event to the at least one external device of the emergency responders when the emergency has occurred. The building information includes the occupancy estimate.

The foregoing paragraph has been provided by way of general introduction, and is not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 3 is an exemplary look-up table that shows occupancy sensors available in a plurality of areas according to one example;

FIG. 7 is an exemplary look-up table according to one example;

DETAILED DESCRIPTION

Figure 1:
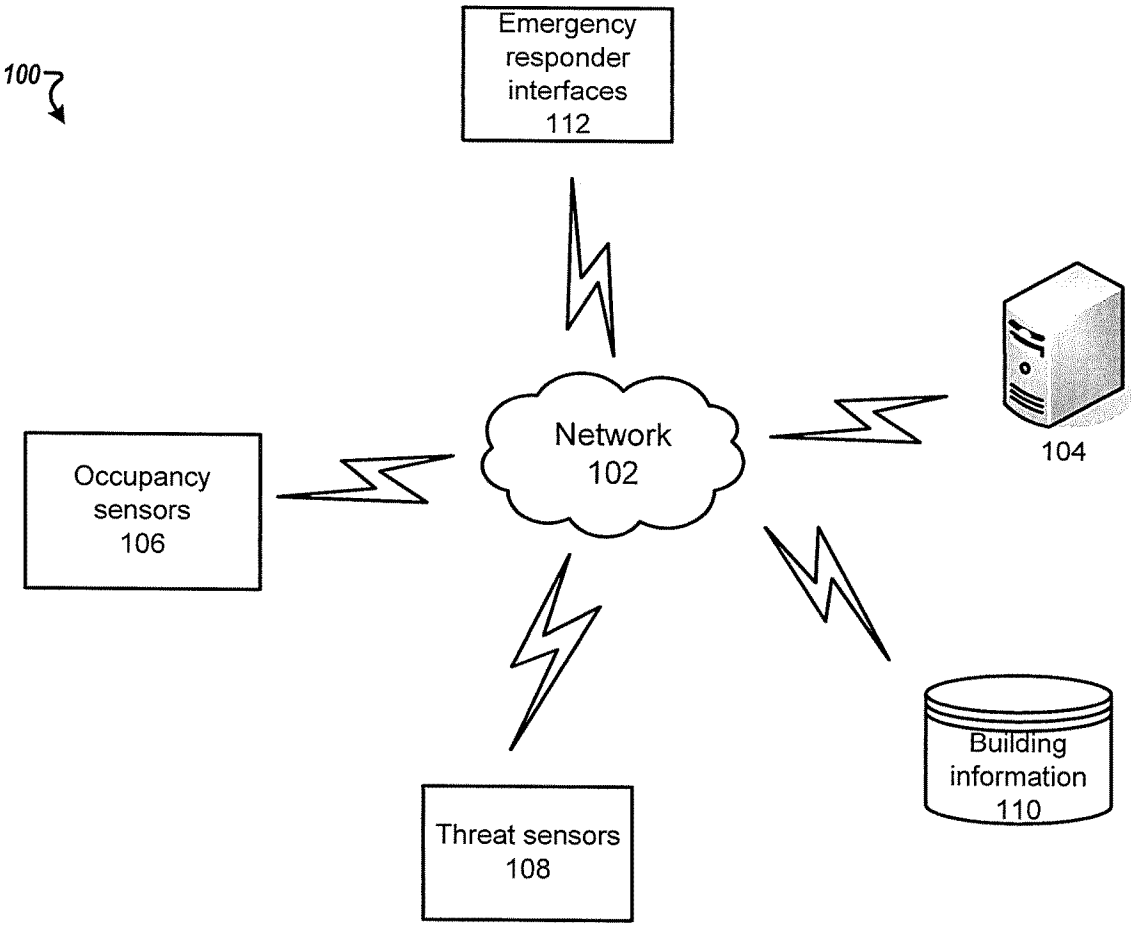
FIG. 1 is a schematic diagram of a system for alerting emergency responders according to one example.

Referring now to the drawings, wherein like reference numerals designate identical or corresponding parts throughout several views, the following description relates to a system and associated methodology for alerting emergency responders. The system provides notifications to emergency responders when an emergency event occurs. The emergency responders may include police, firefighters, emergency medical technicians (EMT), civilian responders, and the like. The notifications include an estimate of individuals at the emergency location determined based on a plurality of factors.

Figure 9:
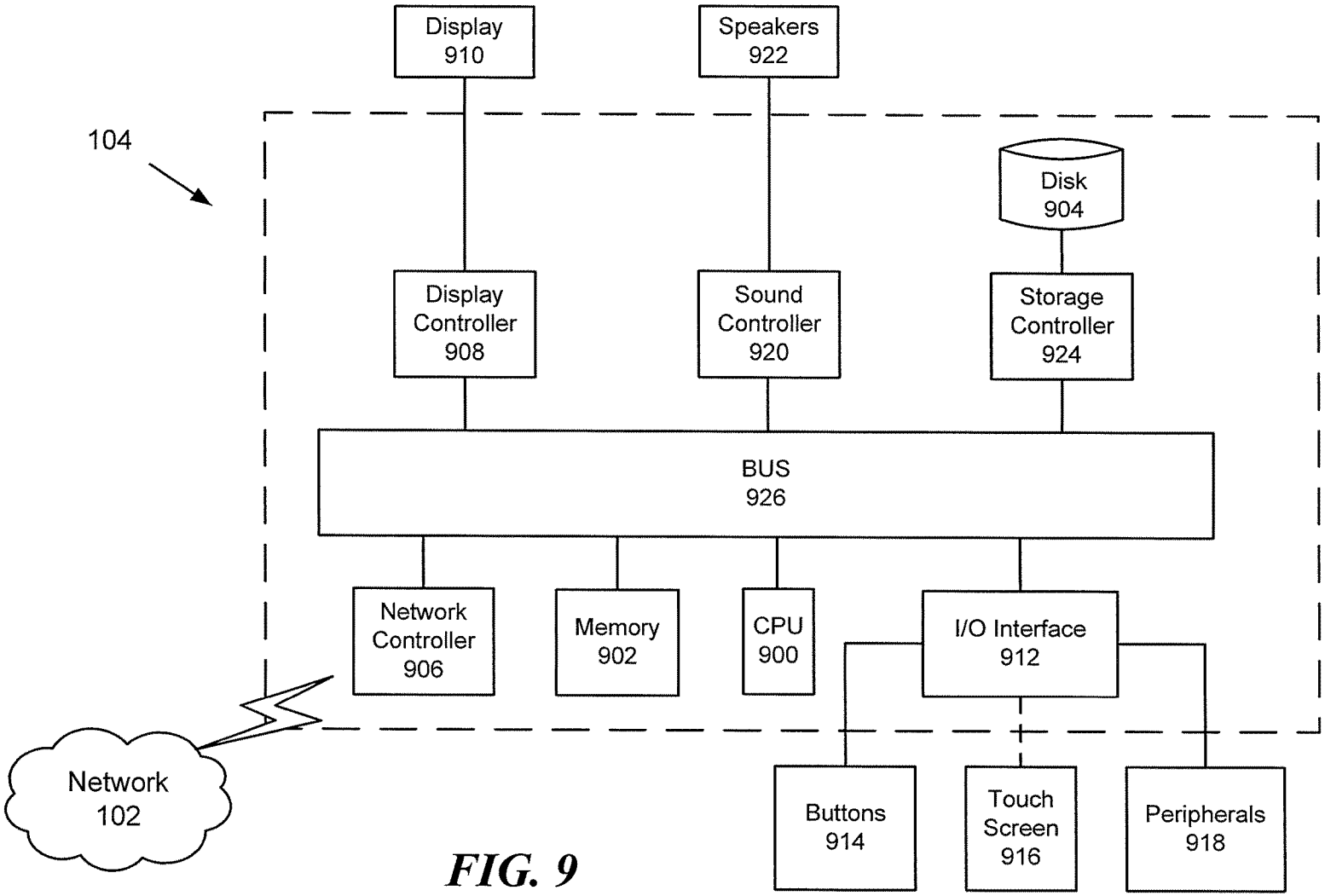
FIG. 9 is an exemplary block diagram of a server according to one example.

FIG. 1 is a schematic diagram of a system for alerting emergency responders according to one example. The system 100 may include a server 104, occupancy sensors 106, threat sensors 108, a building information database 110, and emergency responder interfaces 112. The server 104 is connected to the occupancy sensors 106, the threat sensors 108, the building information database 110, and the emergency responder interfaces 112 via network 102. The server 104 includes a CPU 900 and a memory 902, as shown in FIG. 9.

The occupancy sensors 106 may include, but are not limited to, video sensors, LIDAR sensors, infrared sensors, manual triggers/inspections, pyroelectric detectors, heartbeat detectors, audio sensors, keycard readers, and the like. The occupancy sensors 106 may include an RFID (Radio Frequency Identification) reader that is configured to detect a RFID transmitter included in an identification device (e.g., an identification badge, a key fob). The occupancy sensors 106 may provide occupancy parameters to the server 104. The occupancy parameters can include, but are not limited to, an occupant count, an occupant location, an occupant mobility level, and the like. For example, the occupant location may be determined using indoor localization techniques via a mobile device associated with the occupant.

Suitable networks can include or interface with any one or more of a local intranet, a PAN (Personal Area Network), a LAN (Local Area Network), a WAN (Wide Area Network), a MAN (Metropolitan Area Network), a VPN (Virtual Private Network), or a SAN (storage area network). Furthermore, communications may also include links to any of a variety of wireless networks, including WAP (Wireless Application Protocol), GPRS (General Packet Radio Service), GSM (Global system for Mobile Communication), CDMA (Code Division Multiple Access) or TDMA (Time Division Multiple Access), cellular phone networks, GPS (Global Positioning System), CDPD (Cellular digit packet data), Bluetooth radio, or an IEEE 802.11 based radio frequency.

The network 102 can also include text messaging standards, for example, Short Message Service (SMS), Enhanced Messaging Service (EMS), Multimedia Messaging Service (MMS), or the like.

The threat sensors 108 can include a general threat trigger, a smoke detector, a heat detector, a hazardous material detector, an earthquake sensor, a burglar alarm, an emergency event (e.g., a heart attack), and the like. The threat sensors 108 may provide threat parameters to the server 104 via the network 102. The threat parameters may include, but are not limited to, a threat type, a threat scope, a threat propagation, and a threat pattern. The threat type may include smoke, chemical exposure, fire, or the like. The threat scope may include the number of threat sensors triggered. The threat propagation may include an estimate of the propagation of a threat in a building (e.g., threat moving up in the building, chemical hazard propagation in air conditioning system). The threat pattern may include a trigger time of each of the threat sensors 108. The threat parameters may be determined automatically from the threat sensors 108 or based on one or more inputs from the occupants.

The server 104 determines an estimate of the occupancy (i.e., count) based on a plurality of factors including readings from the occupancy sensors 106 and information stored in the building information database 110. The server 104 may also determine the occupancy parameters (e.g., an occupancy map) as described herein.

The building information database 110 stores personal information about the occupants of a building and building information such as building type (e.g., business, residential), operating hours, floor maps, potential hazards (e.g., chemicals, inflammables), and the like. The building may include any physical area including public venues (e.g., a stadium or an airport), multiple buildings (e.g., a business park or a city block), a portion of a building, an apartment building, a house, a town or city, or the like. The personal information may include name, age, gender, contact information, and associated electronic calendar access information. The server 104 may access an electronic calendar based on the calendar access information to retrieve calendar information associated with an occupant from an external device, email account, etc. This can be done in real-time at the time of an emergency event or ahead of time periodically to update information in the server 104.

The emergency responder interfaces 112 may include a cell phone, a personal computer, a laptop or notebook computer, a personal digital assistant, a smartphone, a tablet, a wearable electronic device, or other handheld devices, any of which may include associated accessories such as microphones, speakers, headphones, visual displays, keypads, or the like. The responder interfaces 112 can communicate with each other, with the server 104 via the network 102.

Figure 2:
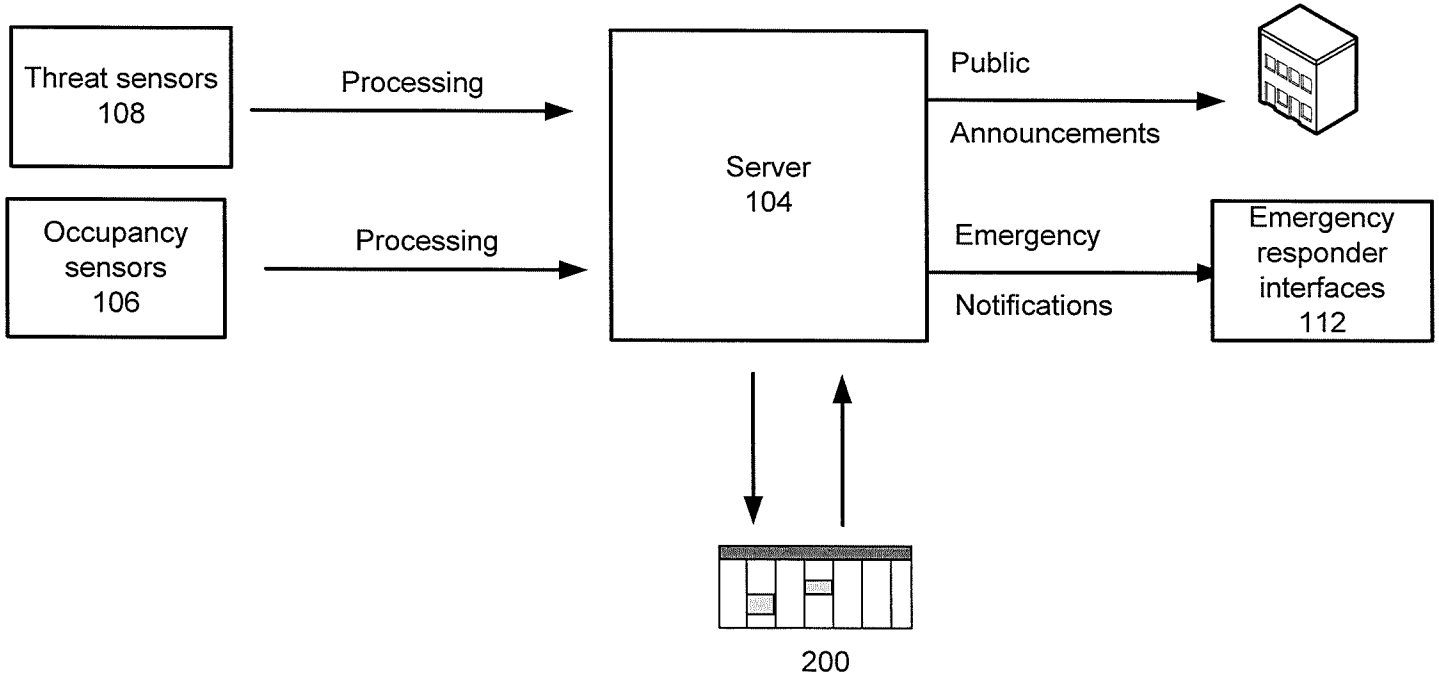
FIG. 2 is a schematic that shows the flow of data through the system according to one example.

FIG. 2 is a schematic that shows the flow of data through the system 100 according to one example. Data from the threat sensors 108 and the occupancy sensors 106 are transmitted to the server 104. The server 104 processes the data to determine whether an emergency event occurred. For example, the server 104 may check whether any of the threat sensors 108 is activated. Further, the server 104 may poll electronic calendars 200 of likely occupants in response to detecting an emergency event. The server 104 generates the occupancy estimate and stores the occupancy estimate in the memory 902. The server 104 may also generate alerts (e.g., public announcements).

FIG. 3 is an exemplary look-up table 300 that shows the occupancy sensors available in a plurality of areas according to one example. Table 300 may include one or more of, but not limited to, a unique sensor identifier, a sensor type, a coverage area, and a status. The status may indicate the status of the sensor. The CPU 900 may avoid using data from a sensor if the status indicates an "Error" which may indicate a failure in the sensor. In one aspect, the CPU 900 may update the status of a sensor to "Not available" when an emergency event is detected. For example, the CPU 900 may predict that a particular type of occupancy sensors may fail based on the emergency event type. For example, occupancy sensors of video type may fail and/or give erroneous readings when the emergency event is "smoke detected". Thus, the server 104 may ignore readings from sensors having a status of "not available" when determining the occupancy estimate.

Figure 4:
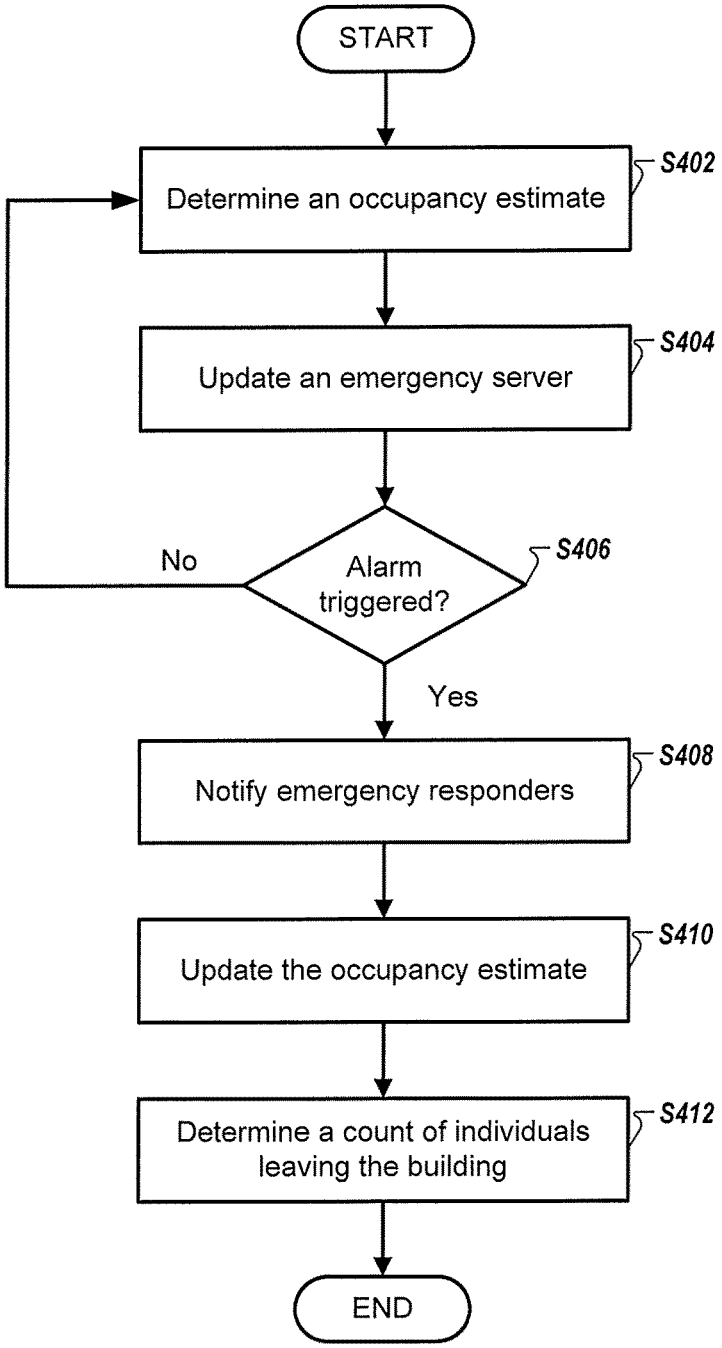
FIG. 4 is a flowchart that shows a method for notifying emergency responders according to one example.
Figure 5:
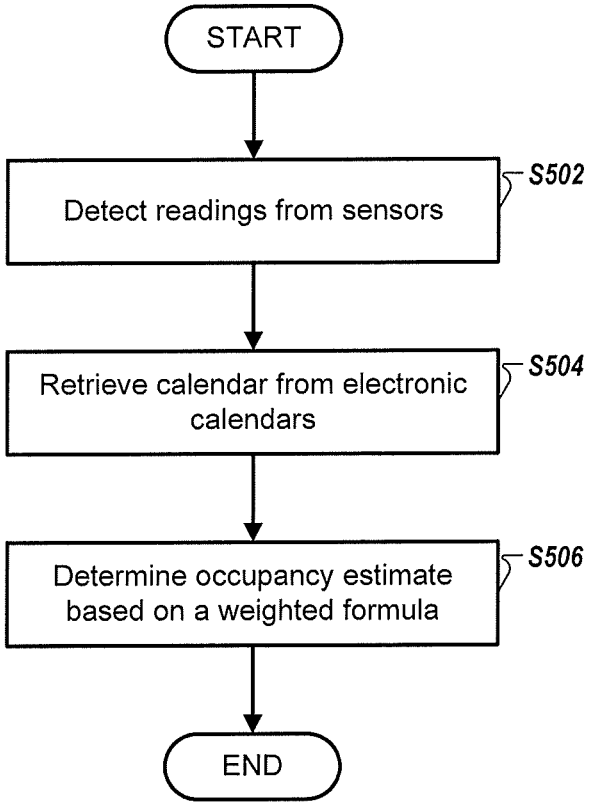
FIG. 5 is a flowchart that shows a method for determining an occupancy estimate according to one example.

FIG. 4 is a flowchart that shows a method for notifying emergency responders according to one example. At step S402, the server 104 may determine an occupancy estimate (i.e. count) based on readings from the occupancy sensors 106 and information stored in the building information database 110. The server 104 may obtain readings from the occupancy sensors periodically (e.g., 10 minutes, 1 hour, 2 hours). The predetermined period may be variable based on a plurality of factors. For example, during non-operating hours of a "business" building, readings from the occupancy sensors may be obtained less frequently than during operating hours. That is, the predetermined period may be longer during non-operating hours, for example, one hour versus 5 minutes. An exemplary method for determining an occupancy estimate is shown in FIG. 5.

At step S404, the occupancy estimate is stored in the memory 902 of the server 104. The occupancy estimate may also be stored in a cloud-based database. Thus, if an emergency event occurs the occupancy estimate is available to the emergency responders regardless of the failure of one or more of the occupancy sensors 106. The server 104 may also store historical data for the building.

At step S406, the server 104 may check to see whether an emergency event has occurred. For example, the server 104 may check whether any of the threat sensors 108 has been triggered. In response to determining that an emergency event has occurred, the process moves to step S408. In response to determining that an emergency event has not occurred, the process goes back to step S402. In one aspect, the server 104 may determine that the emergency event has occurred based on a trigger from a dispatcher center. For example, the emergency event may be triggered by receiving a call or text to an emergency response service number (e.g., 911).

At step S408, the server 104 generates a notification to the emergency responders that an emergency event has occurred at the building. In addition, the server 104 may transmit information about the building to the emergency responders. The information may include the most recent occupancy estimate stored in the memory 902. The information may also include the occupancy parameters. In one aspect, the server 104 may determine the occupancy estimate based on the most recent occupancy estimate stored in the server 104 and historical data. Historical data includes an average occupancy estimate for a similar date/time. For example, if the last occupancy estimate available for building A is determined at 1 p.m. on Thursday (e.g., stored in the memory 902) and the emergency event occurs at 1:30 p.m. on Thursday, then, the server 104 may determine the occupancy estimate as a function of the occupancy estimate of 1 p.m. and an average of past occupancy estimate determined at 1 p.m. on previous Thursdays.

At step S410, the server 104 polls the occupancy sensors 106 to obtain an updated occupancy estimate. The server 104 may check whether one or more of the occupancy sensors 106 have failed due to the emergency event. Then, the server 104 neglects readings from the one or more occupancy sensors that have failed. The server 104 may determine that a reading is erroneous when the reading is higher or lower than a predetermined threshold range. The predetermined threshold may be a function of the maximum occupancy of a building, a room, or the area associated with the occupancy sensor. In addition, when the reading and a previously obtained reading have a percentage difference above a predetermined threshold, then the reading may also be neglected when calculating the occupancy estimate. Upon determining that one or more occupancy sensors have failed, the server 104 may update the look-up table 300. For example, the status of the one or more occupancy sensors that have failed may be changed to "error".

In one aspect, the server 104 may further use a look-up table to match an emergency type with a preferable occupancy sensor type. An exemplary look-up table is shown in FIG. 7. Once the server 104 determines the preferable occupancy sensor type, the server 104 may check table 300 to determine whether an occupancy sensor with the preferable type is available in the building. In response to determining that an occupancy sensor with the preferable type is available, the server 104 determines the occupancy estimate using the occupancy sensor with the preferable type.

At step S412, the server 104 may determine a count of individuals leaving the building. For example, the server 104 may determine the count based on readings from occupancy sensors located at exit doors of the building.

In one aspect, the server 104 may determine whether individuals are evacuating a particular area (e.g., location where the emergency event is detected). The server 104 may check whether the occupancy estimate in the particular area is decreasing. In response to determining that the occupancy estimate is not decreasing, the server 104 may generate a notification to the emergency responders that may include directions to the particular area. Additionally, the server 104 may monitor the rate of evacuating an area as a function of successively determined occupancy estimates. In response to determining that the rate of evacuating the area is below a predetermined threshold which may indicate the presence of an obstacle, a notification may be generated and transmitted to the emergency responders.

Further, the server 104 may identify children, adults, elderly, and animals using objects/subjects recognition methods as would be understood by one of ordinary skill in the art. Then, the server 104 may alert the emergency responders to areas where the occupancy of children/elderly is high.

In one aspect, the server 104 may alert the emergency responders when an individual is not evacuating. For example, the server 104 may generate an alert in response to an individual is detected crossing a virtual boundary line (e.g., individual is moving away from an exit location).

FIG. 5 is a flowchart that shows a method for determining an occupancy estimate according to one example. At step S502, the server 104 may detect readings from the one or more occupancy sensors 106. The server 104 may poll one or more of the occupancy sensors that have the same coverage area. For example, the number of occupancy sensors polled may be based on a desired accuracy level. Additional occupancy sensors may be used until the accuracy level is achieved or all available occupancy sensors are used. For example, the server 104 may obtain a first estimate from a first occupancy sensor and then refine the first estimate based on readings from additional occupancy sensors when a higher accuracy level is desired. Alternatively, the occupancy estimate may be based on readings from an occupancy sensor that minimizes usage of computational or energy resources.

At step S504, the server 104 may retrieve calendar information from electronic calendars of potential occupants of a building to determine whether the occupant is likely in the building. The potential occupants may be retrieved by referencing the building information database 110. One or more electronic calendars (e.g., work, personnel) may be associated with each potential occupant. The calendar information may include any entries in the electronic calendar, such as appointments, meetings, vacations, or other scheduling information. Then, the server 104 may analyze the calendar information to determine whether the individual is in the building. For example, if the calendar entry indicates "physician appointment", the server 104 determines that the individual is likely not in the building. If the calendar entry indicates that the occupant has a meeting at a location inside the building, then the server 104 determines that the individual is likely in the building.

In one aspect, the server 104 may retrieve partial calendar information based on the privacy settings of the user. For example, the server 104 may access the location information of calendar information but not individuals participating or other notes inputted by the potential occupant. In one example, the server 104 may only access calendar information that are set to "public".

At step S506, the server 104 determines the occupancy estimate based on the readings and the occupant likelihood determined at step S504.

A weighted formula may be used to determine the occupancy estimate based on the plurality of estimates. The plurality of estimates may include readings from the occupancy sensors 106 and other factors such as the occupant likelihood. The weight of each estimate may be preset. The weighted formula may be expressed as:

$$\text{Occupancy} = \sum_{i=1}^{n} estimate_i \times weight_i \tag{1}$$

where n is the number of estimates obtained from the plurality of factors.

In one aspect, the weight of each estimate is calculated by the CPU 900 based on historical data. For example, a sensor with a higher accuracy may have a higher weight. The accuracy of the sensor may be determined based on the type of the sensor. Additionally, sensors that may have a partial coverage of an area may have a lower weight. The weight may also be based on the current operation status of each occupancy sensor.

In one aspect, upon determining that an individual is inside the building using a first occupancy detecting method, the system may determine the exact location of the individual using a second occupancy detection method.

In one aspect, the server 104 may poll the status of a potential occupant of the building when an emergency event occurs. The server 104 may retrieve contact information for the potential occupant from the building information database 110. The server 104 may send a status check message to the occupant. In response to the user failing to respond, the server 104 may retrieve calendar information from the electronic calendar of the potential occupant corresponding to the time at which the emergency event occurred. This has the advantage of preserving privacy of occupants for non-public electronic calendar information. When a potential occupant has various contact methods, one of the various contact methods can be selected, and a message can be sent using the selected method. If the selected contact method fails to contact the occupant, then a second contact method is used.

In one aspect, the server 104 may crawl social media data and/or websites associated with the potential occupant of the building to collect the activity data for the potential occupant. Then, the server 104 may determine whether the occupant in the building as a function of the activity data. For example, in response to determining that the potential occupant has "checked-in" at another location around the time at which the emergency event occurred, then the server 104 determines that the occupant is likely not in the building. The server 104 may also check to see whether the potential occupant has posted photos and/or videos at another location.

Figure 6:
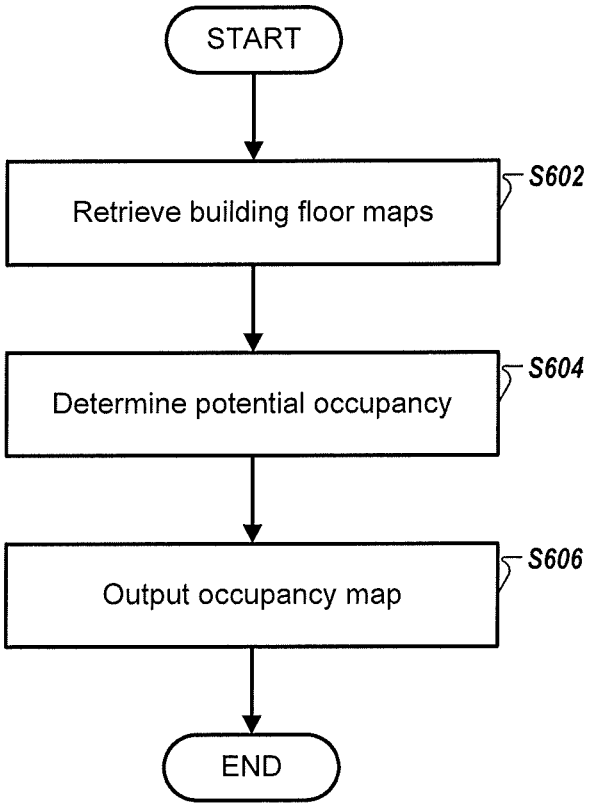
FIG. 6 is a flowchart that shows a method for generating an occupancy map according to one example.

FIG. 6 is a flowchart that shows a method for generating an occupancy map according to one example. At step S602, the server 104 may retrieve floor maps of the building where a threat sensor is activated from the building information database 110. The floor map may include potential occupants' information such as employee workspaces. For example, the location of an occupant office may be stored in the building information database 110.

At step S604, the server 104 may determine an estimate of the occupancy of each of the floors and/or rooms of the building. The estimate may be based on the occupancy estimate of the building and information stored in the building information database 110.

At step S606, the server 104 may generate an occupancy map. The occupancy map indicates the estimate of the occupancy of each of the rooms and/or floors. The occupancy map may include a summary of all occupants. The summary includes the occupancy estimate of the building.

Then, the server 104 sends the occupancy map to the emergency responders and/or emergency dispatchers via the network 102. For example, the occupancy map may be displayed on an electronic device of a responder. As a result, emergency responders can make more informed decisions about the appropriate actions. In addition, the occupancy map may include the threat location. The server 104 may also send the occupancy map to users. Further, the occupancy map may be sent to displays located at the exits/entrances of the building.

In one aspect, the server 104 may indicate the area where the highest number of individuals are probably located on the occupancy map. Further, the notification may include directions to the location with the highest occupancy. Each of the emergency responders may be directed to a given area based on the number of occupants.

FIG. 7 is an exemplary look-up table 700 according to one example. Table 700 shows an association between a sensor type, threat type and the performance of the sensor. For example, a first column may indicate a sensor type. A second column may indicate a threat type. A third column may indicate the performance of the sensor type. The server 104 may decrease the weight of the estimates (e.g., readings) with lower performance for a given threat type and increase the weight of the estimates obtained from sensors with better performance.

Figure 8:
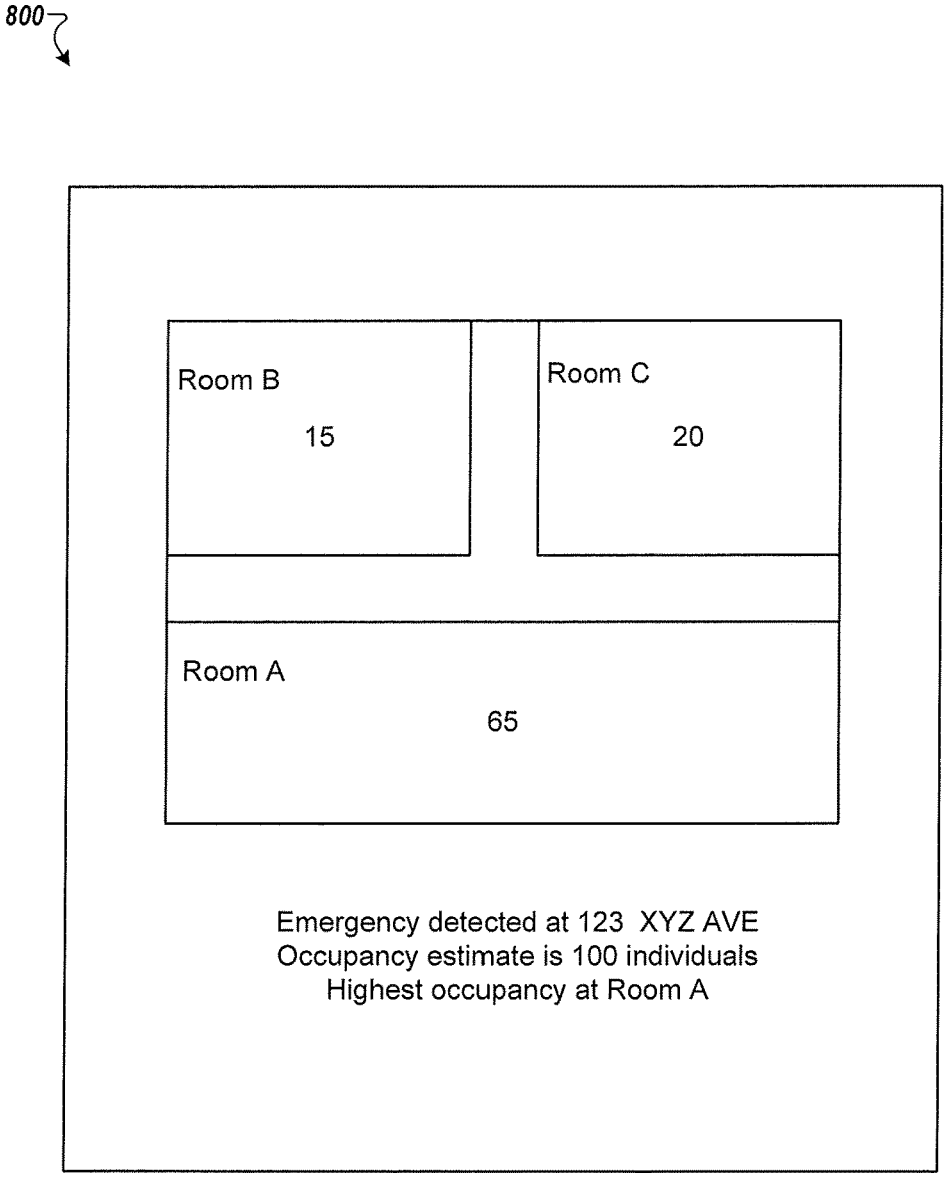
FIG. 8 is an exemplary graphical user interface of an emergency responder interface according to one example.

FIG. 8 is an exemplary graphical user interface 800 of an emergency responder interface according to one example. The graphical user interface 800 may include the occupancy map 802, a field 804 that indicates direction to the highest occupancy area, and a field 804 that shows the summary of the occupancy map.

Next, a hardware description of the server 104 according to exemplary embodiments is described with reference to FIG. 9. In FIG. 9, the server 104 includes a CPU 900 which performs the processes described herein. The process data and instructions may be stored in memory 902. These processes and instructions may also be stored on a storage medium disk 904 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the server 104 communicates, such as a server or computer.

Further, the claimed advancements may be provided as a utility application, background daemon, or component of an operating system, or combination thereof, executing in conjunction with CPU 900 and an operating system such as Microsoft Windows 7, UNIX, Solaris, LINUX, Apple MAC-OS and other systems known to those skilled in the art.

In order to achieve the server 104, the hardware elements may be realized by various circuitry elements, known to those skilled in the art. For example, CPU 900 may be a Xenon or Core processor from Intel of America or an Opteron processor from AMD of America, or may be other processor types that would be recognized by one of ordinary skill in the art. Alternatively, the CPU 900 may be implemented on an FPGA, ASIC, PLD or using discrete logic circuits, as one of ordinary skill in the art would recognize. Further, CPU 900 may be implemented as multiple processors cooperatively working in parallel to perform the instructions of the inventive processes described above.

The server 104 in FIG. 9 also includes a network controller 906, such as an Intel Ethernet PRO network interface card from Intel Corporation of America, for interfacing with network 102. As can be appreciated, the network 102 can be a public network, such as the Internet, or a private network such as LAN or WAN network, or any combination thereof and can also include PSTN or ISDN sub-networks. The network 102 can also be wired, such as an Ethernet network, or can be wireless such as a cellular network including EDGE, 3G and 4G wireless cellular systems. The wireless network can also be WiFi, Bluetooth, or any other wireless form of communication that is known.

The server 104 further includes a display controller 908, such as a NVIDIA GeForce GTX or Quadro graphics adaptor from NVIDIA Corporation of America for interfacing with display 910, such as a Hewlett Packard HPL2445w LCD monitor. A general purpose I/O interface 912 interfaces with a keyboard and/or mouse 914 as well as an optional touch screen panel 916 on or separate from display 910. General purpose I/O interface also connects to a variety of peripherals 918 including printers and scanners, such as an OfficeJet or DeskJet from Hewlett Packard.

A sound controller 920 is also provided in the server 104, such as Sound Blaster X-Fi Titanium from Creative, to interface with speakers/microphone 922 thereby providing sounds and/or music.

The general purpose storage controller 924 connects the storage medium disk X04 with communication bus 926, which may be an ISA, EISA, VESA, PCI, or similar, for interconnecting all of the components of the server 104. A description of the general features and functionality of the display 910, keyboard and/or mouse 914, as well as the display controller 908, storage controller 924, network controller 906, sound controller 920, and general purpose I/O interface 912 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips).

Figure 10:
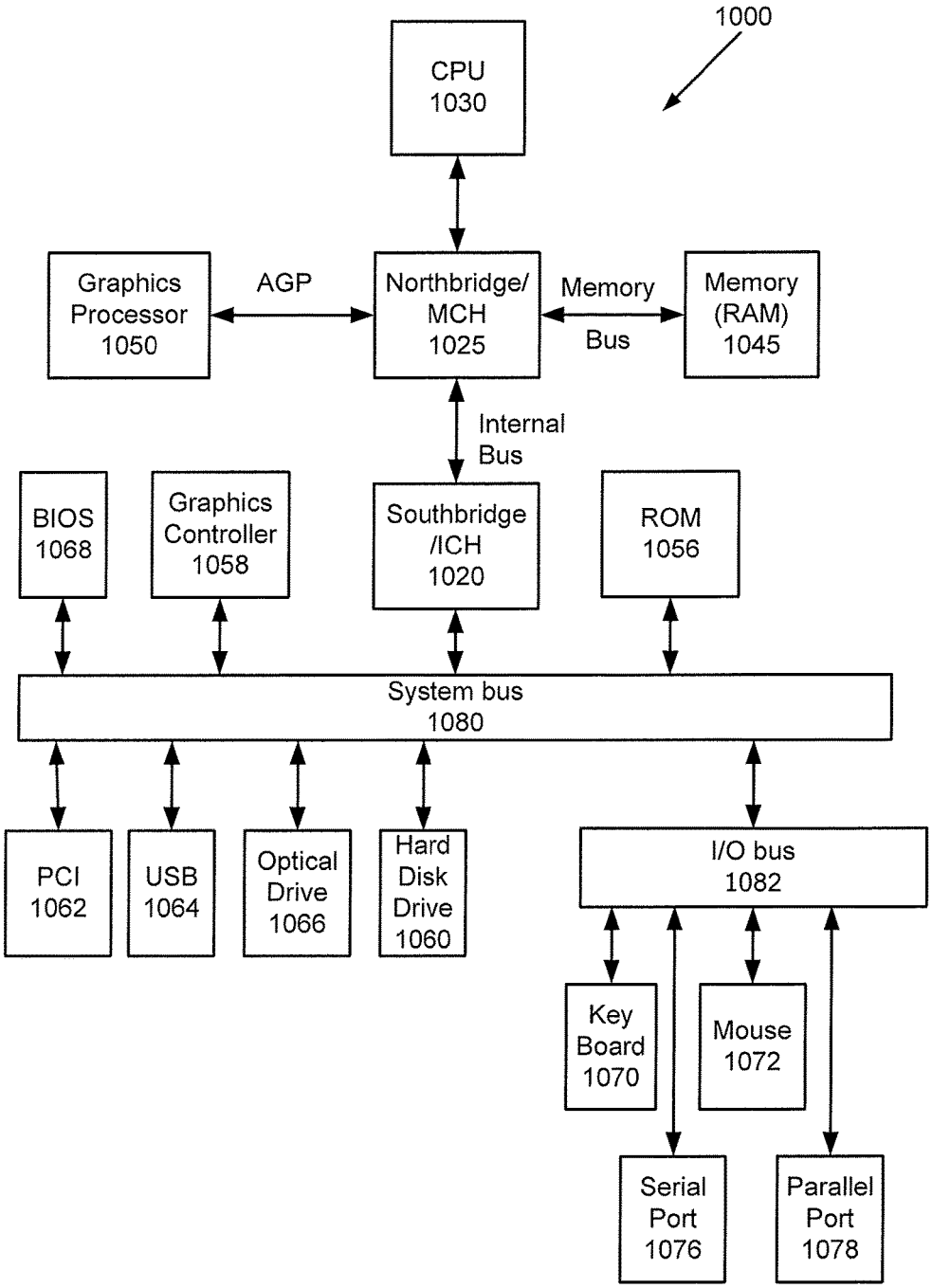
FIG. 10 is an exemplary block diagram of a data processing system according to one example.

FIG. 10 shows a schematic diagram of a data processing system, according to certain embodiments, for alerting emergency responders utilizing the methodologies described herein. The data processing system is an example of a computer in which specific code or instructions implementing the processes of the illustrative embodiments may be located to create a particular machine for implementing the above-noted process.

Figure 11:
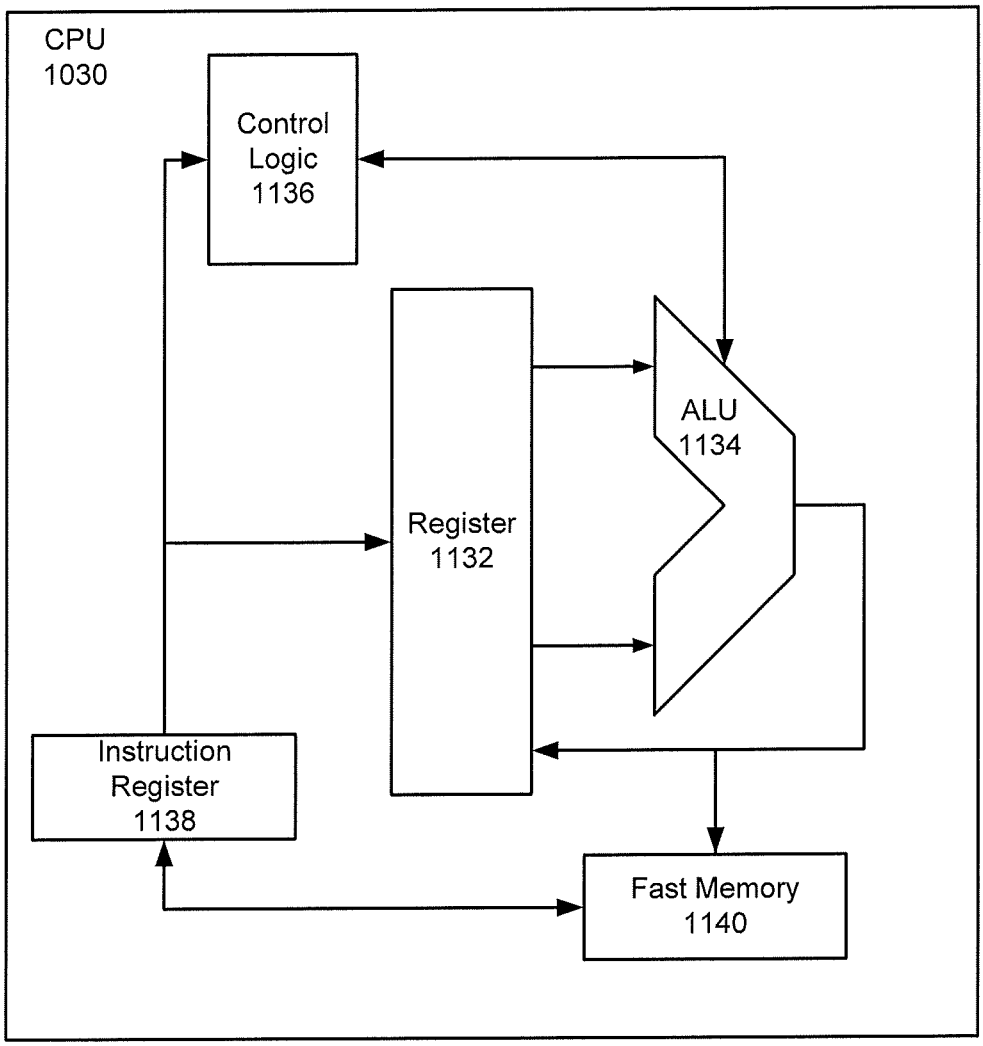
FIG. 11 is an exemplary block diagram of a central processing unit according to one example.

In FIG. 10, data processing system 1000 employs a hub architecture including a north bridge and memory controller hub (NB/MCH) 1025 and a south bridge and input/output (I/O) controller hub (SB/ICH) 1020. The central processing unit (CPU) 1030 is connected to NB/MCH 1025. The NB/MCH 1025 also connects to the memory 1045 via a memory bus, and connects to the graphics processor 1050 via an accelerated graphics port (AGP). The NB/MCH 1025 also connects to the SB/ICH 1020 via an internal bus (e.g., a unified media interface or a direct media interface). The CPU 1030 may contain one or more processors and may even be implemented using one or more heterogeneous processor systems. For example, FIG. 11 shows one implementation of CPU 1030.

Further, in the data processing system 1000 of FIG. 10, SB/ICH 1020 is coupled through a system bus 1080 to an I/O Bus 1082, a read only memory (ROM) 1056, an universal serial bus (USB) port 1064, a flash binary input/output system (BIOS) 1068, and a graphics controller 1058. In one implementation, the I/O bus can include a super I/O (SIO) device.

PCI/PCIe devices can also be coupled to SB/ICH 1020 through a PCI bus 1062. The PCI devices may include, for example, Ethernet adapters, add-in cards, and PC cards for notebook computers. Further, the hard disk drive (HDD) 1060 and optical drive 1066 can also be coupled to the SB/ICH 1020 through the system bus 1080. The Hard disk drive 1060 and the optical drive or CD-ROM 1066 can use, for example, an integrated drive electronics (IDE) or serial advanced technology attachment (SATA) interface.

In one implementation, a keyboard 1070, a mouse 1072, a serial port 1076, and a parallel port 1078 can be connected to the system bus 1080 through the I/O bus 1082. Other peripherals and devices that can be connected to the SB/ICH 1020 include a mass storage controller such as SATA or PATA (Parallel Advanced Technology Attachment), an Ethernet port, an ISA bus, a LPC bridge, SMBus, a DMA controller, and an Audio Codec (not shown).

In one implementation of CPU 1030, the instruction register 1138 retrieves instructions from the fast memory 1140. At least part of these instructions are fetched from the instruction register 1138 by the control logic 1136 and interpreted according to the instruction set architecture of the CPU 1030. Part of the instructions can also be directed to the register 1132. In one implementation, the instructions are decoded according to a hardwired method, and in another implementation, the instructions are decoded according a microprogram that translates instructions into sets of CPU configuration signals that are applied sequentially over multiple clock pulses. After fetching and decoding the instructions, the instructions are executed using the arithmetic logic unit (ALU) 1134 that loads values from the register 1132 and performs logical and mathematical operations on the loaded values according to the instructions. The results from these operations can be feedback into the register and/or stored in the fast memory 1140. According to certain implementations, the instruction set architecture of the CPU 1030 can use a reduced instruction set architecture, a complex instruction set architecture, a vector processor architecture, a very large instruction word architecture. Furthermore, the CPU 1030 can be based on the Von Neuman model or the Harvard model. The CPU 1030 can be a digital signal processor, an FPGA, an ASIC, a PLA, a PLD, or a CPLD. Further, the CPU 1030 can be an x86 processor by Intel or by AMD; an ARM processor, a Power architecture processor by, e.g., IBM; a SPARC architecture processor by Sun Microsystems or by Oracle; or other known CPU architecture.

The present disclosure is not limited to the specific circuit elements described herein, nor is the present disclosure limited to the specific sizing and classification of these elements.

The functions and features described herein may also be executed by various distributed components of a system. For example, one or more processors may execute these system functions, wherein the processors are distributed across multiple components communicating in a network. The distributed components may include one or more client and server machines, which may share processing in addition to various human interface and communication devices (e.g., display monitors, smart phones, tablets, personal digital assistants (PDAs)). The network may be a private network, such as a LAN or WAN, or may be a public network, such as the Internet. Input to the system may be received via direct user input and received remotely either in real-time or as a batch process. Additionally, some implementations may be performed on modules or hardware not identical to those described. Accordingly, other implementations are within the scope that may be claimed.

The above-described hardware description is a non-limiting example of corresponding structure for performing the functionality described herein.

The hardware description above, exemplified by any one of the structure examples shown in FIG. 9 or 10, constitutes or includes specialized corresponding structure that is programmed or configured to perform the algorithm shown in FIG. 4, 5, or 6.

A system which includes the features in the foregoing description provides numerous advantages to users. In particular, the system provides emergency responders with the occupancy estimate of the building. Further, the method determines the occupancy estimate based on readings from a preferable occupancy sensor selected automatically as a function of the type of the emergency. Generating and transmitting a notification including the occupancy estimate to emergency responders and causing the notification to display on the emergency responders' devices improve emergency response time while minimizing errors and potential risks to emergency responders.

Obviously, numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The above disclosure also encompasses the embodiments listed below.

(1) A method for alerting emergency responders, the method including: acquiring readings from one or more occupancy sensors of a building; determining, using processing circuitry of a server, an occupancy estimate based on the readings from the one or more occupancy sensors; storing the occupancy estimate in the server; determining whether an emergency event has occurred at the building based on one or more threat parameters received from one or more threat sensors; outputting a notification to at least one external device of emergency responders when the emergency event has occurred; and transmitting building information associated with the emergency event to the at least one external device of the emergency responders when the emergency event has occurred, the building information including the occupancy estimate.

(2) The method of feature (1), further including determining a type of the emergency event based on readings from the one or more threat sensors; determining a first occupancy sensor type based on a look-up table to match the emergency event type with the first occupancy sensor; and updating the occupancy estimate based on readings from the first occupancy sensor.

(3) The method of feature (1) or (2), further including determining potential occupants of the building by referencing a building information database; retrieving calendar information from one or more electronic calendars of the potential occupants of the building; and updating the occupancy estimate based on the calendar information.

(4) The method of any of features (1) to (3), further including identifying a potential occupant of the building by referencing a building information database; transmitting a status check request to a potential occupant device associated with the potential occupant; and retrieving calendar information from one or more electronic calendars associated with the potential occupant when the potential occupant fails to respond within a predetermined period.

(5) The method of any of features (1) to (4), in which the step of determining the occupancy estimate includes applying $$\text{Occupancy} = \sum_{i=1}^{n} estimate_i \times weight_i$$

where n is the number of estimates obtained from a plurality of factors.

(6) The method of feature (5), in which the plurality of factors include historical data, an accuracy level of an occupancy sensor, and an operation status.

(7) The method of feature (6), in which the accuracy level is determined based on a type of occupancy sensor.

(8) The method of feature (5), in which an occupancy sensor having a partial coverage has a lower weight.

(9) The method of any of features (1) to (8), further including retrieving stored floor maps associated with the building; and generating an occupancy map based on the occupancy estimate and the floor maps, the occupancy map including an estimate of individuals in each area of the building.

(10) The method of feature (9), in which the occupancy map further includes an indication of an area with the highest occupancy.

(11) The method of feature (10), further including generating directions to the area with the highest occupancy.

(12) The method of any of features (1) to (11), further including monitoring a rate of evacuating an area as a function of successively determined occupancy estimates; and outputting a second notification to the at least one external device of the emergency responders when the rate of evacuating the area is below a predetermined threshold.

(13) The method of any of features (1) to (12), in which the readings from the one or more occupancy sensors are periodically acquired.

(14) The method of feature (13), in which the period is based on the operating hours of the building.

(15) The method of feature (14), in which the period is shorter during operating hours than during non-operating hours.

(16) A system for alerting emergency responders, the system includes one or more occupancy sensors; one or more threat sensors; and a server including processing circuitry configured to acquire readings from the one or more occupancy sensors of a building, determine an occupancy estimate based on the readings from the one or more occupancy sensors, store the occupancy estimate in a memory of the server, determine whether an emergency event has occurred at the building based on one or more threat parameters received from the one or more threat sensors, output a notification to at least one external device of emergency responders when the emergency event has occurred, and transmit building information associated with the emergency event to the at least one external device of the emergency responders when the emergency event has occurred, the building information including the occupancy estimate.

(17) The system of feature (16), in which the processing circuitry is further configured to determine a type of the emergency event based on readings from the one or more threat sensors; determine a first occupancy sensor type based on a look-up table to match the emergency event type with the first occupancy sensor; and update the occupancy estimate based on readings from the first occupancy sensor.

(18) The system of feature (16) or (17), in which the processing circuitry is further configured to determine potential occupants of the building by referencing a building information database; retrieve calendar information from one or more electronic calendars of the potential occupants of the building; and update the occupancy estimate based on the calendar information.

(19) The system of any of features (16) to (18), in which the processing circuitry is further configured to identify a potential occupant of the building by referencing a building information database; transmit a status check request to a potential occupant device associated with the potential occupant; and retrieve calendar information from one or more electronic calendars associated with the potential occupant when the potential occupant fails to respond within a predetermined period.

(20) The system of any of features (16) to (19), in which the processing circuitry is further configured to apply $$\text{Occupancy} = \sum_{i=1}^{n} estimate_i \times weight_i$$

where n is the number of estimates obtained from a plurality of factors.

(21) The system of feature (20), in which the plurality of factors include historical data, an accuracy level of an occupancy sensor, and an operation status.

(22) The system of feature (21), in which the accuracy level is determined based on a type of occupancy sensor.

(23) The system of feature (20), in which an occupancy sensor having a partial coverage has a lower weight.

(24) The system of any of features (16) to (23), in which the processing circuitry is further configured to retrieve stored floor maps associated with the building; and generate an occupancy map based on the occupancy estimate and the floor maps, the occupancy map including an estimate of individuals in each area of the building.

(25) The system of feature (24), in which the occupancy map further includes an indication of an area with the highest occupancy.

(26) The system of feature (25), in which the processing circuitry is further configured to generate directions to the area with the highest occupancy.

(27) The system of any of features (16) to (26), in which the processing circuitry is further configured to monitor a rate of evacuating an area as a function of successively determined occupancy estimates; and output a second notification to the at least one external device of the emergency responders when the rate of evacuating the area is below a predetermined threshold.

(28) The system of any of features (16) to (27), in which the readings from the one or more occupancy sensors are periodically acquired.

(29) The system of feature (28), in which the period is based on the operating hours of the building.

(30) The system of feature (29), in which the period is shorter during operating hours than during non-operating hours.

(31) A non-transitory computer readable medium storing instructions, which when executed by at least one processor cause the at least one processor to perform the method of any of features (1) to (15).

The invention claimed is:

1. A method for alerting emergency responders, the method comprising:

acquiring readings from one or more occupancy sensors of a building;

determining, using processing circuitry of a server, an occupancy estimate based on the readings from the one or more occupancy sensors;

storing the occupancy estimate in the server;

determining whether an emergency event has occurred at the building based on one or more threat parameters received from one or more threat sensors;

outputting a notification to at least one external device of the emergency responders when the emergency event has occurred;

transmitting building information associated with the emergency event to the at least one external device of the emergency responders when the emergency event has occurred, the building information including the occupancy estimate;

monitoring a rate of evacuating an area as a function of successively determined occupancy estimates; and outputting a second notification to the at least one external device of the emergency responders when the rate of evacuating the area is below a predetermined threshold.

2. The method of claim 1, further comprising:

determining a type of the emergency event based on readings from the one or more threat sensors;

determining a first occupancy sensor type based on a look-up table to match the emergency event type with the first occupancy sensor; and updating the occupancy estimate based on readings from the first occupancy sensor.

3. The method of claim 1, further comprising:

determining potential occupants of the building by referencing a building information database;

retrieving calendar information from one or more electronic calendars of the potential occupants of the building; and updating the occupancy estimate based on the calendar information.

4. The method of claim 1, further comprising:

identifying a potential occupant of the building by referencing a building information database;

transmitting a status check request to a potential occupant device associated with the potential occupant; and retrieving calendar information from one or more electronic calendars associated with the potential occupant when the potential occupant fails to respond within a predetermined period.

5. The method of claim 1, wherein the step of determining the occupancy estimate includes applying $$\text{Occupancy} = \sum_{i=1}^{n} estimate_i \times weight_i$$

where n is the number of estimates obtained from a plurality of factors.

6. The method of claim 5, wherein the plurality of factors include historical data, an accuracy level of an occupancy sensor, and an operation status.

7. The method of claim 6, wherein the accuracy level is determined based on a type of occupancy sensor.

8. The method of claim 5, wherein an occupancy sensor having a partial coverage has a lower weight.

9. The method of claim 1, further comprising:

retrieving stored floor maps associated with the building; and generating an occupancy map based on the occupancy estimate and the floor maps, the occupancy map including an estimate of individuals in each area of the building.

10. The method of claim 9, wherein the occupancy map further includes an indication of an area with the highest occupancy.

11. The method of claim 10, further comprising:

generating directions to the area with the highest occupancy.

12. The method of claim 1, wherein the readings from the one or more occupancy sensors are periodically acquired.

13. The method of claim 12, wherein the period is based on the operating hours of the building.

14. The method of claim 13, wherein the period is shorter during operating hours than during non-operating hours.

15. A system for alerting emergency responders, the system comprising:

one or more occupancy sensors;

one or more threat sensors; and a server including processing circuitry configured to acquire readings from the one or more occupancy sensors of a building, determine an occupancy estimate based on the readings from the one or more occupancy sensors, store the occupancy estimate in a memory of the server, determine whether an emergency event has occurred at the building based on one or more threat parameters received from the one or more threat sensors, output a notification to at least one external device of the emergency responders when the emergency event has occurred, transmit building information associated with the emergency event to the at least one external device of the emergency responders when the emergency event has occurred, the building information including the occupancy estimate, monitor a rate of evacuating an area as a function of successively determined occupancy estimates, and output a second notification to the at least one external device of the emergency responders when the rate of evacuating the area is below a predetermined threshold.

16. The system of claim 15, wherein the processing circuitry is further configured to:

determine a type of the emergency event based on readings from the one or more threat sensors;

determine a first occupancy sensor type based on a look-up table to match the emergency event type with the first occupancy sensor; and update the occupancy estimate based on readings from the first occupancy sensor.

17. The system of claim 15, wherein the processing circuitry is further configured to:

determine potential occupants of the building by referencing a building information database;

retrieve calendar information from one or more electronic calendars of the potential occupants of the building; and update the occupancy estimate based on the calendar information.

18. The system of claim 15, wherein the processing circuitry is further configured to:

identify a potential occupant of the building by referencing a building information database;

transmit a status check request to a potential occupant device associated with the potential occupant; and retrieve calendar information from one or more electronic calendars associated with the potential occupant when the potential occupant fails to respond within a predetermined period.

19. A non-transitory computer readable medium storing computer-readable instructions therein which when executed by a computer cause the computer to perform a method for alerting emergency responders, the method comprising:

acquiring readings from one or more occupancy sensors of a building;

determining an occupancy estimate based on the readings from the one or more occupancy sensors;

storing the occupancy estimate;

determining whether an emergency event has occurred at the building based on one or more threat parameters received from one or more threat sensors;

outputting a notification to at least one external device of the emergency responders when the emergency event has occurred;

transmitting building information associated with the emergency event to the at least one external device of the emergency responders when the emergency event has occurred, the building information including the occupancy estimate monitoring a rate of evacuating an area as a function of successively determined occupancy estimates; and outputting a second notification to the at least one external device of the emergency responders when the rate of evacuating the area is below a predetermined threshold.

* * * * *